US007394376B1

(12) United States Patent
Sayegh et al.

(10) Patent No.: US 7,394,376 B1
(45) Date of Patent: Jul. 1, 2008

(54) THEFT DETERRENT TAG

(76) Inventors: Adel O. Sayegh, 5143 Paddock Pl., Rancho Cucamonga, CA (US) 97137; Shaoshan Li, 1418 Moganshan Rd., Hangzhou (CN) 31005; Wei Shang, 12-1-702 Huayuangongyu, Wenhua Road, Hangzhou (CN) 310012

( * ) Notice: Subject to any disclaimer, the term of this patent is extended or adjusted under 35 U.S.C. 154(b) by 102 days.

(21) Appl. No.: 11/255,428

(22) Filed: Oct. 19, 2005

(51) Int. Cl.
*G08B 13/14* (2006.01)

(52) U.S. Cl. ..... 340/572.1; 340/572.9; 340/568.1; 340/573.1; 343/873; 343/788

(58) Field of Classification Search ... 340/572.1–572.9, 340/571, 568.1, 573.4, 870.17, 573.1; 343/873, 343/788
See application file for complete search history.

(56) References Cited

U.S. PATENT DOCUMENTS

| | | | | |
|---|---|---|---|---|
| 3,974,581 | A | 8/1976 | Martens et al. | |
| 3,995,900 | A | 12/1976 | Humble et al. | |
| 4,380,097 | A | 4/1983 | Keifer | |
| 4,670,950 | A | 6/1987 | Wisecup et al. | |
| 5,068,641 | A | 11/1991 | Hogen Esch | |
| 5,069,047 | A | 12/1991 | Lynch et al. | |
| 5,127,687 | A * | 7/1992 | Guiler | 292/327 |
| 5,140,836 | A | 8/1992 | Hogan et al. | |
| 5,347,262 | A * | 9/1994 | Thurmond et al. | 340/572.9 |
| 5,426,419 | A * | 6/1995 | Nguyen et al. | 340/572.9 |
| 5,969,613 | A * | 10/1999 | Yeager et al. | 340/572.9 |
| 6,326,890 | B1 | 12/2001 | Costa | |
| 6,366,206 | B1 * | 4/2002 | Ishikawa et al. | 340/573.1 |
| 6,769,281 | B2 * | 8/2004 | Irie et al. | 72/121 |
| 6,848,285 | B2 | 2/2005 | Stroh | |
| 6,897,827 | B2 * | 5/2005 | Senba et al. | 343/873 |
| 7,073,236 | B2 * | 7/2006 | Xue et al. | 24/704.1 |
| 7,293,335 | B2 * | 11/2007 | Tseng et al. | 24/429 |
| 2004/0172988 | A1 | 9/2004 | Gorst | |
| 2004/0237267 | A1 | 12/2004 | Copen et al. | |
| 2006/0070410 | A1 | 4/2006 | Fuss | |

* cited by examiner

*Primary Examiner*—George A Bugg
*Assistant Examiner*—Daniel Previl
(74) *Attorney, Agent, or Firm*—Milord A. Keshishian

(57) ABSTRACT

An article surveillance tag that has a shock absorbing mechanism that prevents unauthorized removal of the tag by the application of a strike force to the tag by a blunt object. In one embodiment, the article surveillance tag is adapted to engage articles that cannot be penetrated by pins.

18 Claims, 8 Drawing Sheets

THEFT DETERRENT TAG

CROSS-REFERENCE TO RELATED APPLICATIONS

The contents of this application are related to United States design patent applications titled "ELECTRONIC ARTICLE SURVEILLANCE TAG" and "ELECTRONIC ARTICLE SURVEILLANCE UNIT" having serial numbers 29/240,195 and 29/240,196, respectively, filed on Oct. 11, 2005, the contents of which are incorporated herein by reference.

FIELD OF THE INVENTION

The invention relates to theft deterrent security tags in general, and in particular to a security tag that is attachable to items to be monitored which items cannot be penetrated by a pin.

BACKGROUND OF THE INVENTION

Various types of electronic article surveillance (EAS) systems are known having the common feature of employing a marker or tag which is affixed to an article to be protected against theft from a controlled area, such as merchandise in a store. When a legitimate purchase of the article is made, the marker can either be removed from the article, or converted from an activated state to a deactivated state. Such systems employ a detection arrangement, commonly placed at all exits of a store, and if an activated marker passes through the detection system, it is detected by the detection system and an alarm is triggered.

Such electronic detection arrangements, as used in the present invention, are well known in the art and are more clearly discussed in co-pending U.S. patent application Ser. No. 10/410,486, titled "Article Surveillance Tag Having a Metal Clip," filed on Apr. 8, 2003, which is incorporated herein by reference. A discussion of the inventions in the field, known to the inventor, and their differences from the present invention is provided below.

U.S. Pat. Nos. 3,911,534 and 3,974,581 to Henry J. Martens et al. disclose a security tag having the pin contained on a first strip that is hingedly attached to a second strip that has the locking component thereon. The pin of the first strip penetrates the article that is to be secured and is received in the locking component of the second strip such that the article is maintained therebetween. The hinged attachment may lead to the bending of the pin when contacting the locking component because of the predetermined arc that it must travel as a result of the hinged arrangement. Some items of merchandise are solid and cannot be pierced with the attachment pin used by some EAS tags. Lanyards have been developed for these products.

The '534 and '581 patents also disclose a pin soldered to a chain at one end and the other end of the chain riveted to the tag cover. A drawback with existing lanyards is that they may be severed to remove the tag holder from the item of merchandise. Once severed, the tag holder is destroyed and must be replaced. Some existing lanyards are difficult to assemble and require both ends of the lanyard to be held in alignment while the sharp tack of the holder is threaded through the ends of the lanyard.

In addition, the prior art, such as U.S. Pat. No. 5,069,047 to Lynch, discloses pin clutch mechanisms that function by forcing a plurality of balls around the pin member by a resilient means, which balls are disengaged from said pin by the use of a magnet. However, such pin clutch mechanisms are defeated by sharply striking the tag with a tool, such as a hammer, which release the balls from engagement with the pin. The prior art, such as U.S. Pat. No. 5,140,836 to Hogan, discloses a tag that can be attached to articles without piercing the same with a pin. However, such devices may be defeated by simply cutting through the engaging member. Furthermore, because the engaging member is detachable from the tag, it can be misplaced or lost by the user.

The prior art does not address the need for an EAS tag that is difficult to defeat and easy to use. In addition, the prior art fails to provide a theft deterrent tag assembly that can be securely engaged to articles that cannot be penetrated by a pin. Therefore, there remains a long standing and continuing need for an advance in the art of EAS and theft deterrent tags that makes the tags more difficult to defeat, simpler in both design and use, more economical and efficient in their construction and use, and provide a more secure and reliable engagement of the article to be monitored.

SUMMARY OF THE INVENTION

Accordingly, it is a general object of the present invention to overcome the disadvantages of the prior art.

It is another objective of the invention to provide a cost-efficient EAS tag.

It is another objective of the invention to provide an EAS tag that is durable.

It is a further objective of the invention to provide an EAS tag that is detachable when used with an authorized detaching unit.

It is a further objective of the invention to provide an EAS tag that provides a tag that can be attached to an item to be monitored without penetrating the item.

It is still a further objective of the invention to provide a theft deterrent device that can be quickly and easily secured to an article made of varying materials to prevent the unauthorized removal of the article.

It is yet a further object of the invention to provide a rugged theft deterrent unit to permit the repeated use thereof.

It is still a further object of the invention to provide a theft deterrent unit with a locking mechanism that can withstand a strike thereto by a hammer.

In keeping with the principles of the present invention, a unique EAS theft deterrent tag is disclosed wherein the tag is capable of engaging articles that are to be monitored without necessitating the puncture of the articles with a pin. In addition, by providing a first and second half that are hingedly attached, labor time and costs are reduced when removing the tag from an article being protected thereby because separate bins are not required for the two halves. In addition, replacement costs are further reduced because the mates to the tags cannot be separated and lost.

In addition, the magnetic force necessary to disengaged the attaching mechanism of the tag is greater than required in the prior art ball and clutch mechanisms. Furthermore, the attaching mechanism of the instant invention provides a shock absorbing mechanism to prevent defeat of the attaching mechanism by the application of a strike force thereto by a blunt object.

Such stated objects and advantages of the invention are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the invention. In the drawings, wherein similar reference characters denote similar elements throughout the several views.

DETAILED DESCRIPTION OF THE INVENTION

Figure 1:
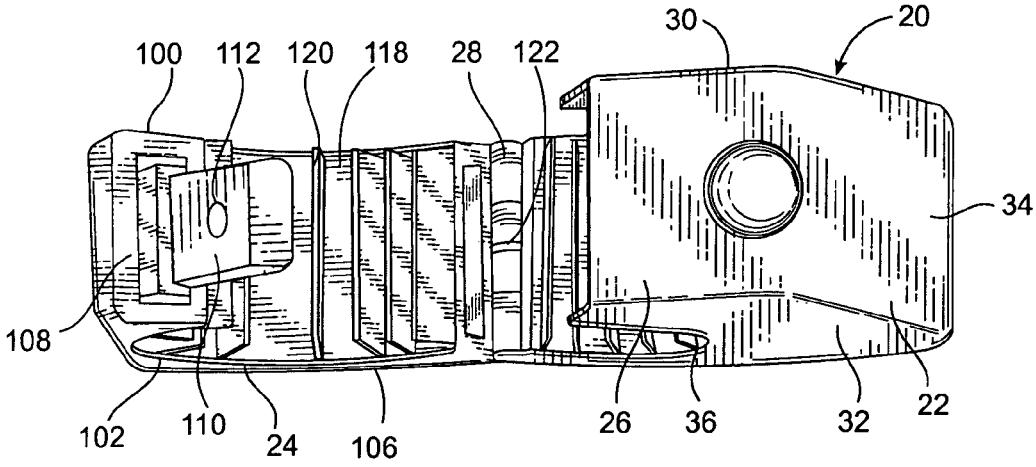
FIG. 1 is a front perspective view of the tag of the instant invention in an unengaged state.

Referring now to FIGS. 1 through 4, a tag 20 is illustrated having a first half 22 and a second half 24. First and second halves 22 and 24 are preferably made of a hard or rigid material and are adapted to attach to one another and form a front end 26 and a rear end 28. A usable rigid or hard material might be a hard plastic such as, for purposes of illustration but not limitation, an injection molded ABS plastic. First and second halves 22 and 24 are hingedly attached at rear end 28 and are detachably attached at the front end 26 by an attaching means.

Figure 5:
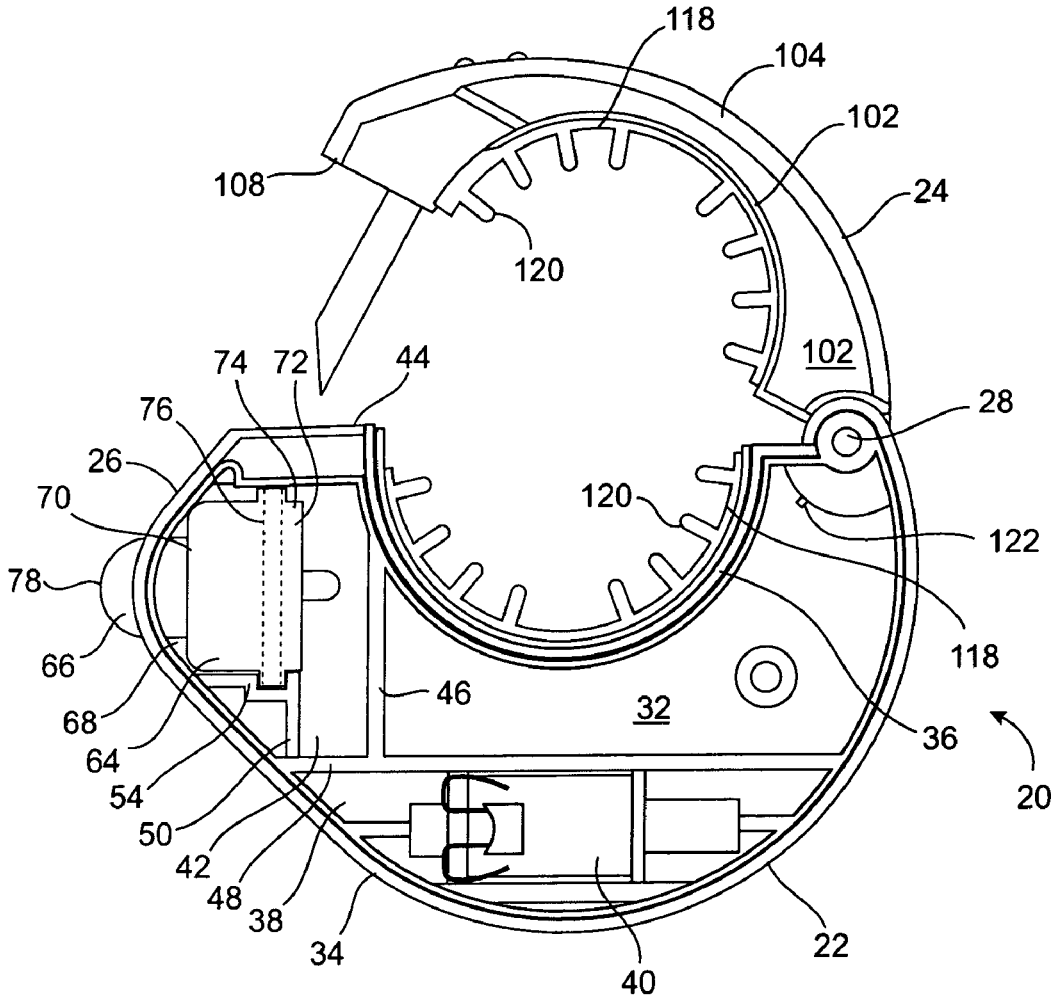
FIG. 5 is a left side elevational view of the tag with the first left wall removed.
Figure 6:
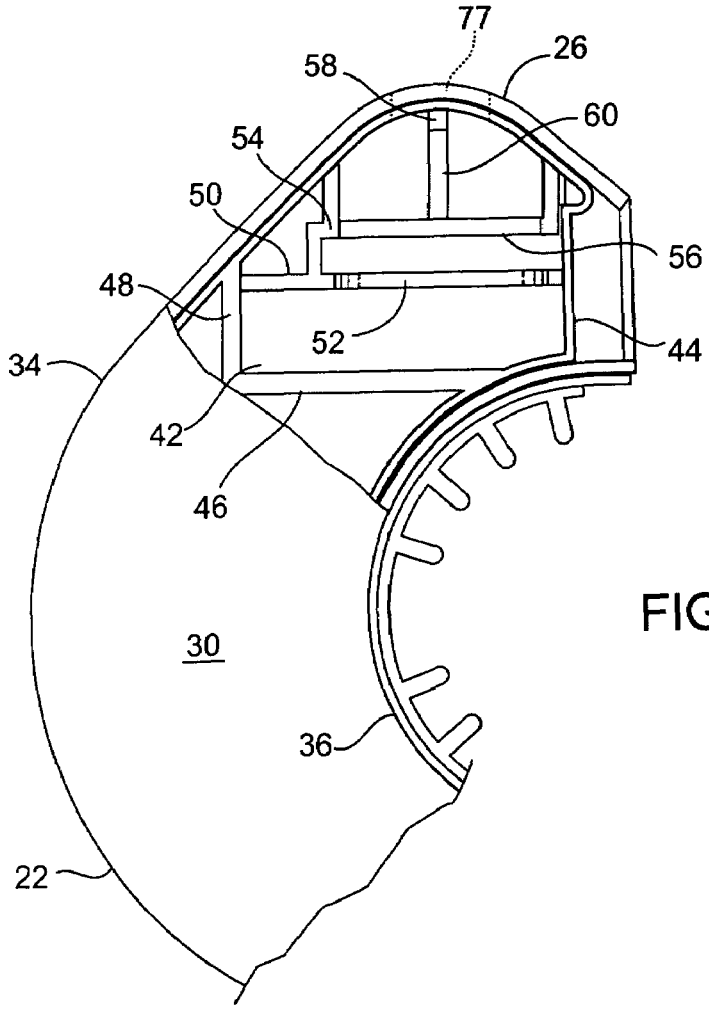
FIG. 6 is a partial cut-away view of a first half of the tag in an unassembled and unengaged state.

Now also referring to FIGS. 5 and 6, first half 22 has first left wall 30 and a first right wall 32 interconnected at the periphery thereof by a first outer wall 34 and a first inner wall 36, thereby a space is formed therebetween. In a preferred embodiment, ABS plastic material is used to make tag 20 whereby first left wall 30 and, first outer wall 34, and first inner wall 36 may be injection molded and then first right wall 32 is then joined with first outer wall 34 and first inner wall 36 via an ultrasonic weld, or adhesive, or other joining means known in the art.

First half 22 has a first compartment 38 defined therein which receives an electronic surveillance means 40. Electronic surveillance means may be a resonant tag circuit which is not the subject of the instant invention and a detailed description thereof is disclosed in U.S. patent application Ser. No. 10/410,486, titled "Article Surveillance Tag Having a Metal Clip," filed on Apr. 8, 2003, which is incorporated herein by reference. It is to be understood that alternate resonant tag circuitry that is known in the art may also be used with the instant invention. Electronic surveillance means 40 functions with electronic article surveillance systems that are well known in the art to prevent theft and similar unauthorized removal of articles from a controlled area.

A second compartment 42 is formed within first half 22 and an opening 44 to second compartment 42 is formed through first inner wall 36. A first partition 46 and end partition 48 extend between first left wall 30 and first right wall 32, wherein first partition 46 is substantially perpendicular to end partition 48. A second partition 50 extends substantially perpendicularly from end partition 48 and from first right wall 32 and is substantially parallel to first partition 46. Second partition 50 has a second semi-circular cut out region 52 defined therein and second partition 50 does not extend to first left wall 30. A third partition 54 extends substantially perpendicularly from first right wall 32 and is substantially parallel to second partition 50. Third partition 54 also defines a third semi-circular cut-out region 56 that is axially aligned with second semi-circular cut out region 52 of second partition 50. A fourth partition 58 extends perpendicularly from first right wall 32 and is substantially perpendicular to third partition 54. Fourth partition 58 also defines a fourth semicircular cut-out region 60. Similar partitions as partitions 50, 54 and 58 extend from first left wall 30 in mirror fashion (not shown).

Figure 7:
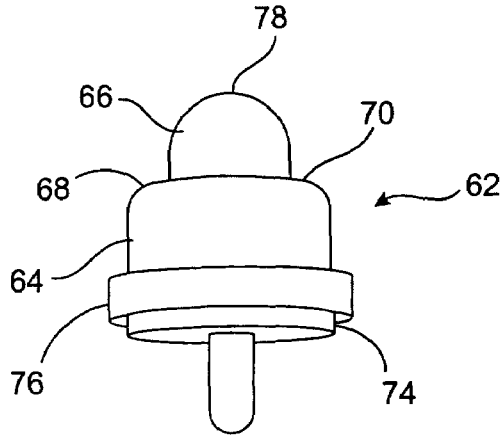
FIG. 7 is a perspective view of first and second members as removed from the tag.
Figure 8:
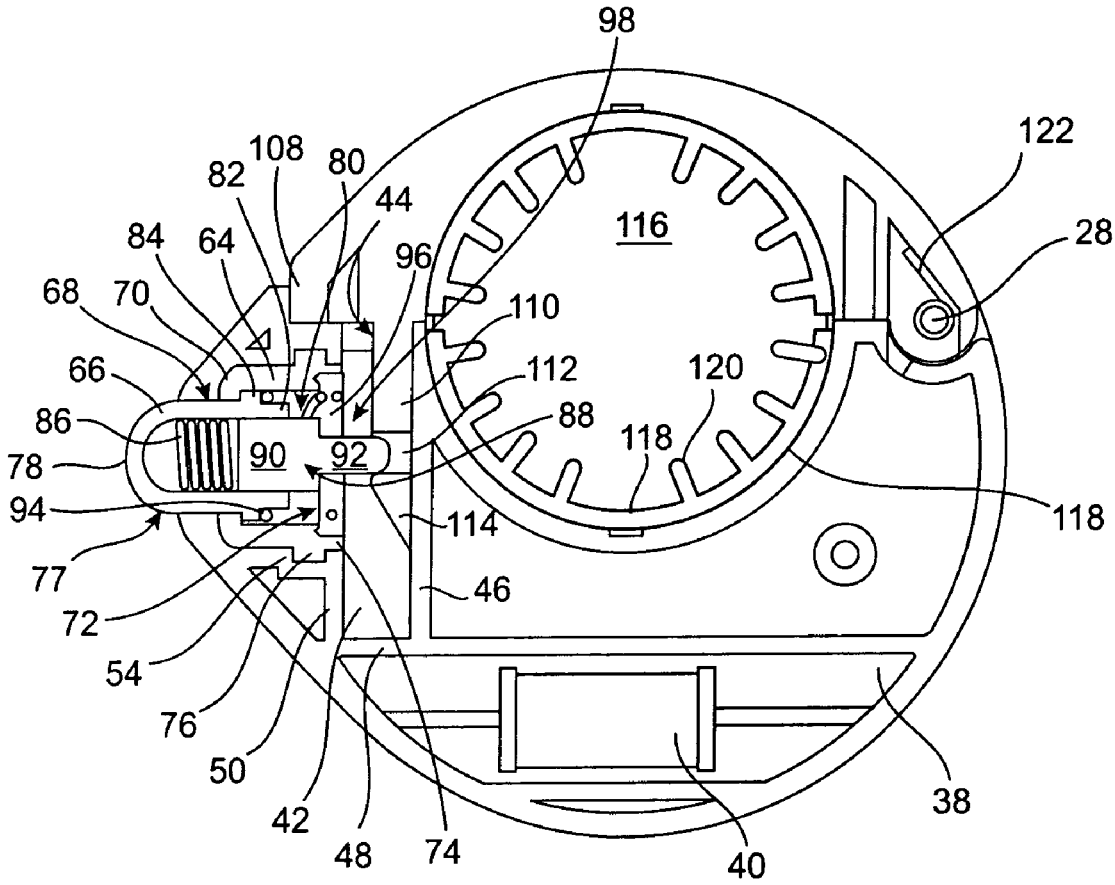
FIG. 8 is a cross-sectional view of the tag taken along line 8-8 of FIG. 3.
Figure 9:
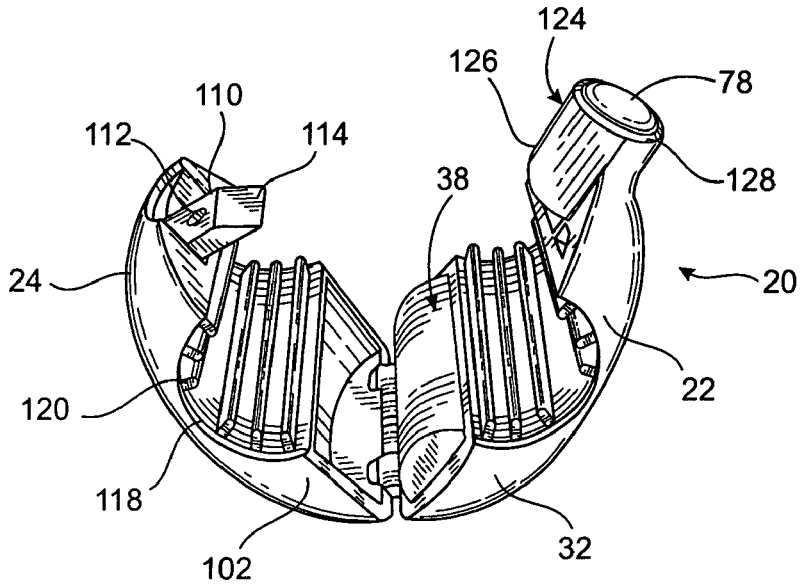
FIG. 9 is a right side perspective view of an alternate preferred embodiment of the tag in an unengaged state.
Figure 10:
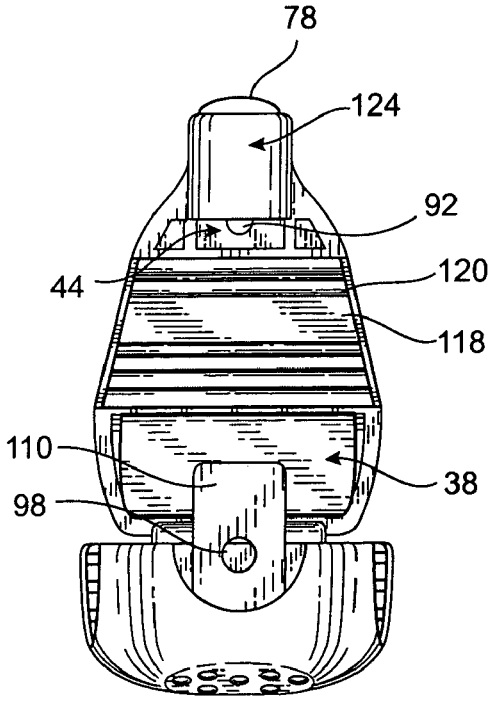
FIG. 10 is a front outer perspective view of the alternate preferred embodiment of the tag in an unengaged state.
Figure 11:
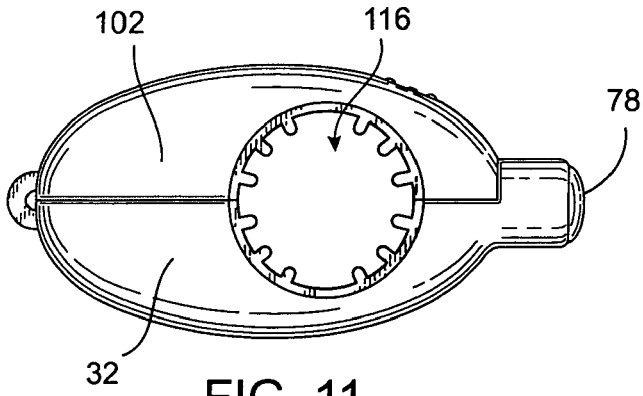
FIG. 11 is a right side elevational view of the alternate preferred embodiment of the tag in an engaged state.
Figure 12:
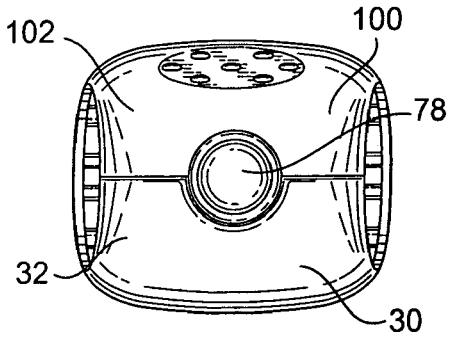
FIG. 12 is a front perspective view of the alternate preferred embodiment of the tag in an engaged state.
Figure 13:
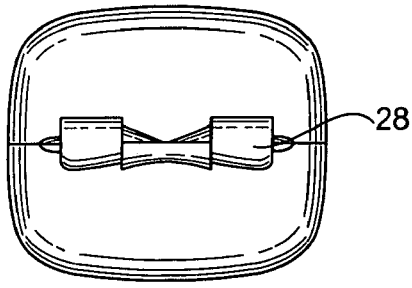
FIG. 13 is a rear plan view of the alternate preferred embodiment of the tag in an engaged state.
Figure 14:
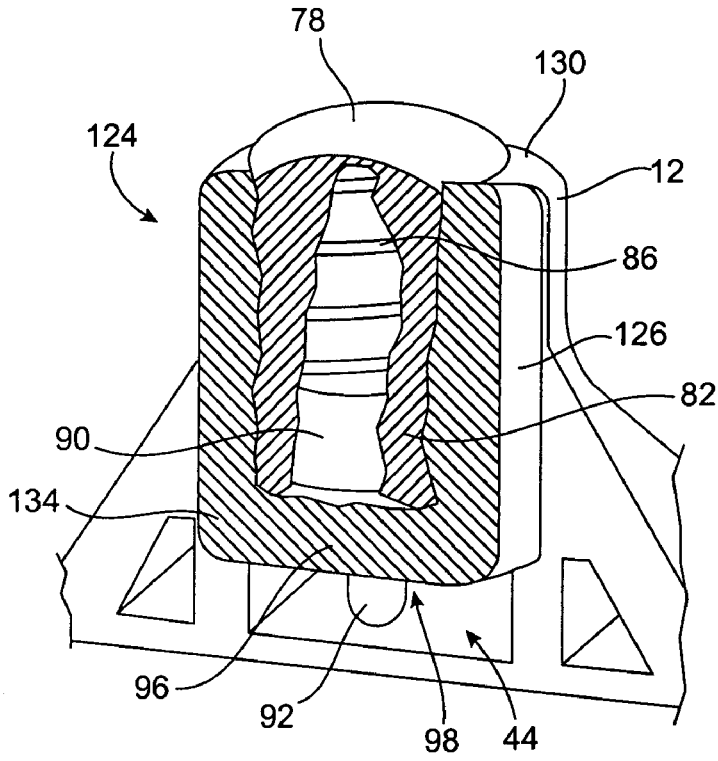
FIG. 14 is a partial cut away side view of first member of the tag.
Figure 15:
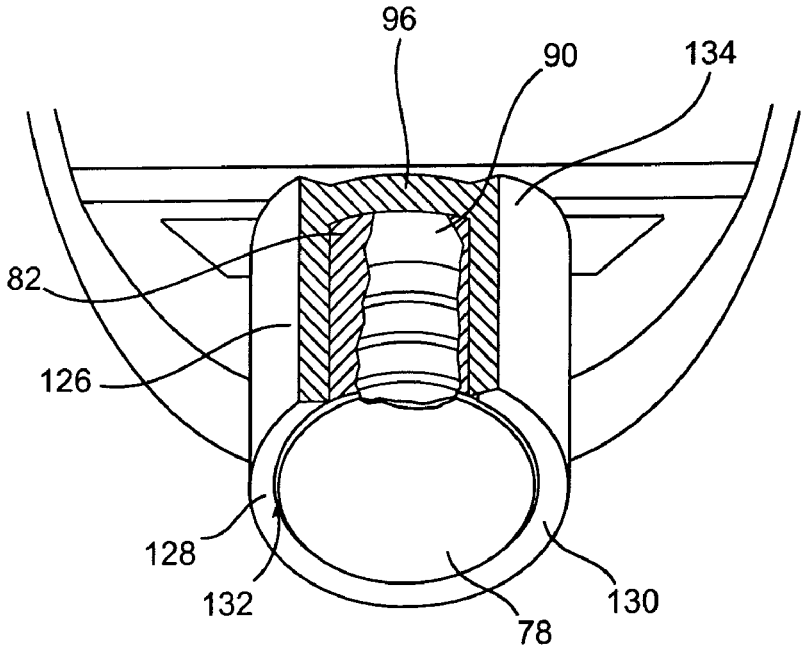
FIG. 15 is a partial cut away front view of first member of the tag.

Now also referring to FIGS. 7 and 8, an attaching mechanism 62 has a first member 64 and a second member 66. First member 64 is substantially tubular having a first aperture 68 at a top end 70 and a second aperture 72 at a bottom end 74, wherein said top end 70 curves inwardly such that first aperture 68 has a smaller circumference than second aperture 72. First member 74 has a circumferentially extending first lip 76 that is of sufficient thickness to be received between second partition 50 and third partition 54 when the tag is in an assembled state. In addition, third partition 58 also engages top end 70 of first member 64 when the tag 20 is in an assembled state. When the tag 20 is in an assembled state, first aperture 68 is axially aligned with an orifice 77 defined through first outer wall 34 of first half 22.

Second member 66 has a domed end 78 and a third aperture 80 defined at an opposing end 82. A circumferential second lip 84 extends outwardly from second member 66 at a region closer to opposing end 82. The domed end 78 extends through first aperture 68 of first member 64 such that second lip 84 engages top end 70 thereof and is securely maintained therein. The domed end 78 further extends through orifice 77 when tag 20 is in an assembled state. A first resilient means 86 is received and maintained within the domed end 78, and in a preferred embodiment, first resilient means 86 is a spring. An attaching member 88 has a base region 90 and an elongated attaching region 92 and attaching member 88 is slideably received within second member 66 and engages first resilient means 86 at the base region 90 such that attaching region 92 extends away from domed end 78. Resilient means 86 is positioned for forcing attaching member 88 toward third aperture 80. Attaching member 88 is made of a material that responds to magnetic forces and in a preferred embodiment is made of stainless steel. A second resilient means 94, which in a preferred embodiment is a spring, engages second lip 84 and extends towards third aperture 80.

A cover 96, that is substantially circular, is secured to first member 64 and covers second aperture 72 and encloses second member 66, first resilient means 86, attaching member 88, and second resilient means 94. A bore 98 is defined through cover 96 and is axially aligned with third aperture 80. Bore 98 is of sufficient size to allow attaching region 92 to pass through yet engages base region 90 by cover 96.

Second half 24 has a second left wall 100 and a second right wall 102 interconnected at the periphery thereof by a second outer wall 104 and a second inner wall 106, thereby a space is formed therebetween. Second half 24 has a leading end 108 that is distal to rear end 28. An attaching component 110 extends from leading end 108 and attaching component 110 is adapted to engage attaching member 88 in a secure yet releasable manner. Attaching component 110 defines a cavity 112 which is adapted to receive attaching region 92 of attaching member 88 therein in a secure manner. In a preferred embodiment, attaching component 110 has a front edge 114 that is beveled and when attaching component 110 is inserted into second compartment 42, front edge 114 forces attaching region 92 towards domed end 78. As attaching component 110 travels further into second compartment 42, cavity 112 becomes axially aligned with attaching region 92 and first resilient means 86 forces attaching region 92 into cavity 112 and securely maintains attaching component 110 within second compartment 42.

In such attached position, as illustrated in FIG. 8, first inner wall 36 and second inner wall 106 oppose one another and can maintain an article to be monitored securely therebetween. In a preferred embodiment, first inner wall 36 and second inner wall 106 define a opening 116, which is preferably circular in nature, that can receive an article to be monitored securely therein. Opening 116 can be made to predetermined dimensions to receive various sporting articles such as, but not limited to, baseball bats, golf clubs, tennis racquets, and baseball mitts. In a preferred embodiment, strips of material 118 (e.g. rubber or elastic material) may be attached to first and second inner walls 36 and 10 to provide additional friction in engaging the article retained therebetween. Additionally, a plurality of ribs 120 may extend inwardly from material 118 to add further friction in engaging the article retained therein.

In order to allow the removal of tag 20 from an article maintained therein, a magnet having a predetermined amount of magnetic force for overcoming the force applied by first resilient means 86 on attaching member 88 is applied to domed end 78. When the predetermined amount of magnetic force is applied to domed end 78, attaching member 88 is forced to move towards domed end 78 by compressing first resilient means 86 which thereby withdraws attaching region 98 from engagement with attaching component 110 and attaching component 110 can now be withdrawn from second compartment 42. Upon removal of the magnetic force, resilient means 86 recoils and forces attaching region 92 to its attaching state to receive attaching component 110.

The amount of magnetic force necessary to overcome the force applied by the first resilient means 86, is greater than the force necessary to overcome the force applied by springs of the ball and clutch mechanisms in the prior art. Such stronger magnets are not as readily available to miscreants that would attempt to defeat the article surveillance provided by tag 20.

Second resilient mans 94 acts as a shock absorber if tag 20 is struck with a hammer in an attempt to defeat tag 20. When tag 20 is struck, second resilient means 94 absorbs the oscillations that may be caused by movement of second member 66 toward cover 96. Furthermore, as a result of such movement, second resilient means 86 is compressed and applies greater force on base region 90 of attaching member 88 thereby maintaining secure engagement of attaching region 92 with attaching component 110.

Figure 2:
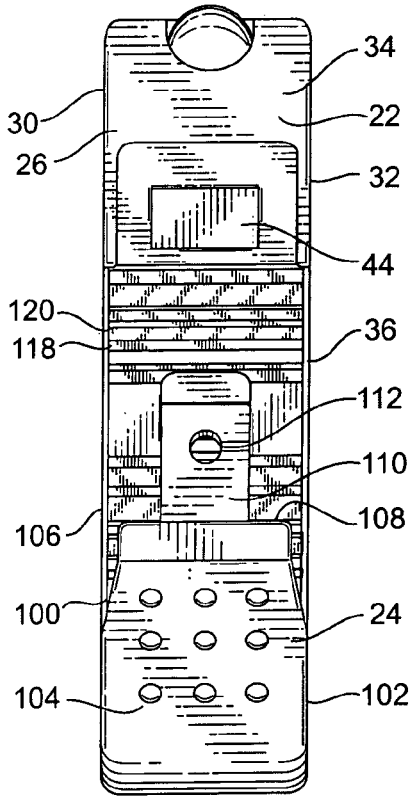
FIG. 2 is a front outer perspective view of the tag.
Figure 3:
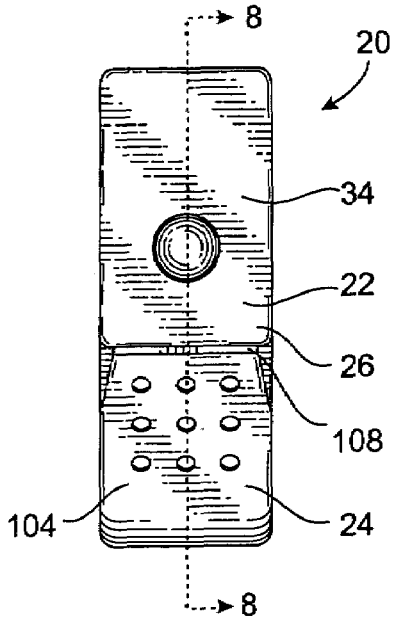
FIG. 3 is a front perspective view of the tag in an engaged state.
Figure 4:
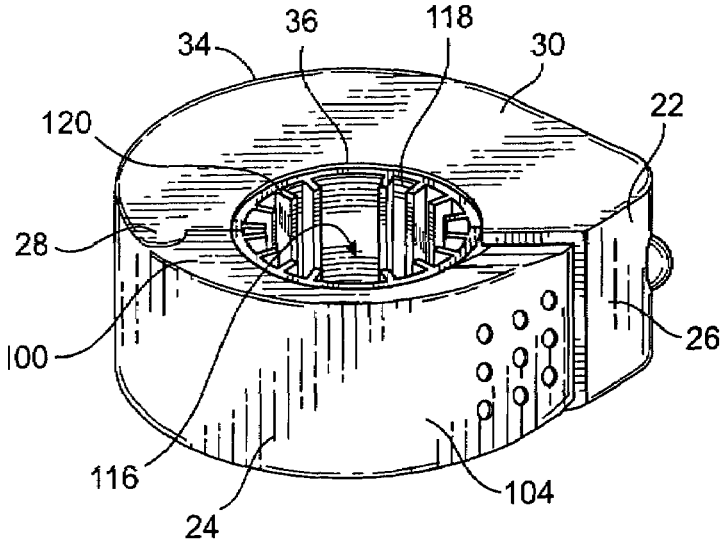
FIG. 4 is a left side perspective view of the tag in an engaged state.

In a preferred embodiment, a biasing element 122 is installed in rear end 28 and functions with the hinged attachment thereof to maintain tag 20 in a normally unattached state as illustrated in FIGS. 1 and 2. Accordingly, when a magnetic force is applied to domed end 78 causing withdrawal of attaching region 92 from attaching component 110, tag 20 assumes the unattached state as a result of biasing element 122. In a preferred embodiment, biasing element 122 is a coiled member.

Now referring to FIGS. 9 through 15, an alternate preferred embodiment of tag 20 is disclosed having another preferred attaching means. Second member 66 now has an opposing end 82 that is of a greater diameter than domed end 78 whereby a substantially conical form is achieved. A retaining wall 124 extends from first half 22 is adapted to retain second member 66 therein in a secure yet moveable manner. Retaining wall 124 has a top half 126 and a bottom half 128, wherein bottom half 128 is injection molded with first half 22 and top half 126 is attached to bottom half 22 to enclose second member 66 therebetween. Top half 126 and bottom half 128 define a leading end 130 which defines a hole 132 through which domed end 78 extends. A trailing end 134 is formed at an end of retaining wall 124 that is distal to the leading and 130. Trailing end 134 has cover 96 attached thereto with bore 98 that allows passage of attaching region 92. By allowing second member 66 to move within retaining wall 124, it allows shock absorption if tag 20 is struck by a hammer. Authorized disengagement of tag 20 is achieved in the manner as previously detailed by the application of a magnetic force sufficient to overcome the force applied by first resilient means 86.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. An article surveillance tag having an improved attaching system, comprising:

a first half and an opposing second half that are rotationally attached at a rear end and are removeably attached at a front end, where said attaching member is located at the front end of said first half and said attaching component is defined at the front end of said second half;

a detectable electronic article surveillance means located within the tag;

an attaching member having an attaching region that is removeably engaged to an attaching component; and a shock absorbing mechanism;

whereby, said shock absorbing mechanism prevents unauthorized removal of the tag by the application of a striking force by a blunt object to the tag and a probe is not needed to disengage the tag.

2. The device of claim 1, wherein the attaching member is part of an attaching mechanism, said attaching mechanism further comprises:

a first member and a second member, wherein the first member is substantially tubular having a first aperture at a top end and a second aperture at a bottom end, wherein said top end curves inwardly such that said first aperture has a smaller circumference than said second aperture;

a domed end defined on said second member and a third aperture defined at an opposing end of said second member distal to said domed end;

a circumferential lip extends outwardly from said second member at a region closer to said opposing end, wherein the domed end extends through said first aperture of said first member such that said lip engages the top end thereof and is securely, yet slideably, maintained therein;

a first resilient means is received and maintained within the domed end, wherein the attaching member is slideably received within said second member and engages first resilient means such that the attaching member is forced away from the domed end;

a second resilient means engages said second lip and extends towards the third aperture;

a cover is secured to said first member and covers said second aperture and encloses the second member and the first resilient means, the attaching member, and the second resilient means;

a bore is defined through cover and is of sufficient size to allow a portion of the attaching region to extend there through to engage the attaching component.

3. The device of claim 2, wherein the attaching member is made of a material that responds to magnetic forces.

4. The device of claim 2, wherein the attaching member is made of stainless steel and is not spherical.

5. The device of claim 2, wherein the tag is comprised of a first half and an opposing second half that are rotationally attached at a rear end and are removeably attached at a front end, where said attaching mechanism is defined at the front end of said first half and said attaching component is defined at the front end of said second half.

6. The device of claim 5, wherein an orifice is defined through said first half through which the domed end extends and the orifice is of a predetermined size such that the attaching mechanism is maintained within the first half.

7. The device of claim 5, wherein an opening is defined in said first half such that the attaching component is inserted therein and is securely, yet removably, engaged by said attaching region.

8. The device of claim 5, wherein an opening is defined in said first half and is transverse to the axial alignment of said attaching region, whereby the attaching component is inserted into said opening and securely, yet removably, engaged by said attaching region.

9. The device of claim 8, wherein said attaching component has a beveled front edge and a trailing cavity such that insertion of the attaching component into the opening pushes the attaching region toward the domed end in an initial stage, and after the cavity is aligned with the attaching region, the first resilient means forces the attaching region into said cavity such that the attaching component is securely, yet removeably, maintained within the opening.

10. The device of claim 9, wherein the application of a predetermined amount of magnetic force overcomes the force asserted by the first resilient means on the attaching region and withdraws the attaching region from engagement with said attaching component allowing withdrawal thereof.

11. The device of claim 2, wherein the second resilient means serves as the shock absorbing mechanism if the tag is struck with a blunt object in an attempt to defeat the tag.

12. An electronic article surveillance tag having an improved attaching mechanism, comprising:

a first half and an opposing second half forming the tag body, and the first half and second half rotationally attached at a rear end;

an attaching mechanism located at a front end of said first half; an attaching component located at the front end of said second half, whereby said attaching mechanism and attaching component securely, yet removably, engage one another enclosing an object to be monitored between the first and second halves;

a shock absorbing mechanism located within the attaching mechanism to reduce a possibility of defeat of the attaching mechanism;

a resilient means is located within the attaching mechanism and acts as the shock absorbing mechanism and absorbs any oscillations that are caused by a strike to the tag by a blunt object;

a detectable electronic article surveillance means located within the tag.

13. The device of claim 12, wherein the attaching mechanism further comprises:

a first member and a second member, wherein the first member is substantially tubular having a first aperture at a top end and a second aperture at a bottom end, wherein said top end curves inwardly such that said first aperture has a smaller circumference than said second aperture;

a domed end defined on said second member and a third aperture defined at an opposing end of said second member;

a circumferential lip extends outwardly from said second member at a region closer to said opposing end, wherein the domed end extends through said first aperture of said first member such that said lip engages the top end thereof and is securely maintained therein;

a first resilient means is received and maintained within the domed end, wherein an attaching member is slideably received within said second member and engages first resilient means such that the attaching member is forced away from the domed end;

the shock absorbing resilient means engages said lip and extends towards third aperture;

a cover is secured to said first member and covers said second aperture and encloses the second member and the first resilient means, the attaching member, and the resilient means such that the resilient means rests on said cover;

a bore is defined through the cover and is of sufficient size to allow a portion of the attaching member to extend there through to engage the attaching component.

14. The device of claim 13, wherein the resilient means absorbs any oscillations that are caused by a strike to the tab by a blunt object, whereby the resilient means is compressed and applies greater force to the lip which in turn causes first resilient means to apply a greater force to a base region of the attaching member thereby maintaining secure engagement of an attaching region, located at an opposing end to the base region, with the attaching component.

15. The device of claim 13, wherein the application of a predetermined amount of magnetic force overcomes the force asserted by the first resilient means on the attaching region and withdraws the attaching region from engagement with said attaching component allowing withdrawal thereof.

16. The device of claim 12, wherein an opening is defined in said first half and is transverse to the axial travel of an attaching member, whereby the attaching component is inserted into said opening and removably engaged by an attaching region;

a beveled front edge and a trailing cavity defined on the attaching component such that insertion of the attaching component into the opening pushes an attaching region defined in the attaching mechanism away from the attaching component in an initial stage, and after the cavity is aligned with the attaching region, a first resilient means located within the attaching mechanism forces the attaching region into said cavity such that the attaching component is securely, yet removeably, maintained within the opening.

17. An electronic article surveillance tag having an improved attaching mechanism, comprising:

a first half and an opposing second half forming the tag body, and the first half and second half rotationally attached at a rear end;

an attaching mechanism located at a front end of said first half and comprising a substantially conically shaped member having a closed domed end and an open opposing end, a first resilient means is located within the member proximal to the domed end, an attaching member having a base region and a distal attaching region slideably rests within the member such that the base region rests on the first resilient means, a retaining wall circumferentially encloses the member such that there is slideable movement within the retaining wall but it does not allow removal of the member from the retaining wall, the retaining wall further defining a cover at proximal to the attaching region, a bore defined through the cover that allows passage of the attaching region there through but maintains prevents passage of the base region;

an attaching component located at the front end of said second half, whereby said attaching region and the attaching component securely, yet removably, engage one another enclosing an object to be monitored between the first and second halves;

a shock absorbing mechanism located within the attaching mechanism to reduce a possibility of defeat of the attaching mechanism, the shock absorbing mechanism created by the slideable movement of the member within the retaining wall;

a detectable electronic article surveillance means located within the tag.

18. The device of claim 17, wherein an opening is defined in said first half and its transverse to the axial travel of said attaching mechanism, whereby the attaching component is inserted into said opening and removably engaged by said attaching region;

a beveled front edge and a trailing cavity defined on the attaching component such that insertion of the attaching component into the opening pushes the attaching region away from the attaching component in an initial stage, and after the cavity is aligned with the attaching region, the first resilient means located forces the attaching region into said cavity such that the attaching component is securely, yet removably, maintained within the opening.

* * * * *